US009796020B2

(12) United States Patent
Åslund

(10) Patent No.: US 9,796,020 B2
(45) Date of Patent: Oct. 24, 2017

(54) METHOD FOR THE MANUFACTURE OF A METAL PART

(75) Inventor: Christer Åslund, Torshälla (SE)

(73) Assignee: Metec Powder Metal AB, Karlskoga (SE)

( * ) Notice: Subject to any disclaimer, the term of this patent is extended or adjusted under 35 U.S.C. 154(b) by 1379 days.

(21) Appl. No.: 13/140,162

(22) PCT Filed: Jan. 8, 2010

(86) PCT No.: PCT/SE2010/050011

§ 371 (c)(1),
(2), (4) Date: Jun. 16, 2011

(87) PCT Pub. No.: WO2010/080063

PCT Pub. Date: Jul. 15, 2010

(65) Prior Publication Data

US 2011/0256015 A1 Oct. 20, 2011

Related U.S. Application Data

(60) Provisional application No. 61/144,085, filed on Jan. 12, 2009.

(30) Foreign Application Priority Data

Jan. 12, 2009 (SE) ..... 09500075

(51) Int. Cl.

| | |
|---|---|
| ***B22F 3/24*** | (2006.01) |
| ***B22F 3/16*** | (2006.01) |
| ***B22F 3/15*** | (2006.01) |
| ***C22C 33/02*** | (2006.01) |
| *B22F 3/04* | (2006.01) |
| *B22F 3/087* | (2006.01) |

(52) U.S. Cl.

CPC ..... *B22F 3/16* (2013.01); *B22F 3/15* (2013.01); *C22C 33/0257* (2013.01); *B22F 3/04* (2013.01); *B22F 3/087* (2013.01); *B22F 2998/10* (2013.01)

(58) Field of Classification Search

CPC ..... B22F 3/16
USPC ..... 419/28
See application file for complete search history.

(56) References Cited

U.S. PATENT DOCUMENTS

| | | | | |
|---|---|---|---|---|
| 6,334,882 | B1 * | 1/2002 | Åslund | 75/228 |
| 2008/0202651 | A1 * | 8/2008 | Uenosono et al. | 148/579 |

FOREIGN PATENT DOCUMENTS

| | | | |
|---|---|---|---|
| DE | 197 52 505 | C1 | 4/1999 |
| GB | 2 084 612 | A | 4/1982 |
| JP | 63-250405 | A | 10/1988 |
| JP | 04-180504 | A | 6/1992 |
| JP | 2007-138273 | A | 6/2007 |

OTHER PUBLICATIONS

J.C. Kosco, Mechanical Properties of High-Performance Powder Metallurgy Parts, Powder Metal Technologies and Applications, vol. 7, ASM Handbook, ASM International, 1998, p. 947-956, as excerpted in ASM Handbooks Online.*

International Preliminary Report on Patentability for corresponding International Application No. PCT/SE2010/050011 dated Jul. 12, 2011.

Barendvanden Bos et al., "Industrial Implementation of High Velocity Compaction for Improved Properties", Powder Metallurgy, 2006, vol. 49, No. 2, pp. 107-109, ISSN 0032-5899.

International Search Report for corresponding International Application No. PCT/SE2010/050011 mailed May 11, 2010.

* cited by examiner

*Primary Examiner* — Jonathan Johnson
*Assistant Examiner* — Christopher Kessler
(74) *Attorney, Agent, or Firm* — Renner, Otto, Boisselle & Sklar, LLP

(57) ABSTRACT

A method for the manufacture of a metal part, the method including the steps: a) compacting agglomerated spherical metal powder to a preform, b) debinding and sintering the preform to a part at a temperature not exceeding 1275° C., c) performing one of the following steps: i) compacting the part to a density of more than 95% of the theoretical density, or ii) compacting the part to a density of less than 95% of the theoretical density and sintering the part at a temperature not exceeding 1275° C. to a density of more than 95% of the theoretical density, and d) subjecting the part to hot isostatic pressing at a temperature not exceeding 1200° C. The method provides an industrial process to produce fully dense parts from alloys which normally cannot be produced and still give good impact properties, which is vital for many applications where there alloys are used.

6 Claims, 4 Drawing Sheets

1= *M6C
2=*FCC_A1#1
3=*FCC_A1#2
4=*LIQUID
5=*BCC_A2
6=*M7C3

Alloy 100 Cr6 1.3505

| Fe | C | Si | Mn | P | S | Cr | Ni | Cu |
|---|---|---|---|---|---|---|---|---|
| Bal. | 0.95 | 0.25 | 0.40 | 0.03 | 0.03 | 1.5 | <0.3 | <0.3 |

METHOD FOR THE MANUFACTURE OF A METAL PART

This application is a national phase of International Application No. PCT/SE2010/050011 filed Jan. 8, 2010 and published in the English language, which claims priority to SE 0950007-5 filed Jan. 12, 2009 and U.S. 61/144,085 filed Jan. 12, 2009.

TECHNICAL FIELD

The present invention relates to a method for the manufacture of metal parts from agglomerated spherical metal powder.

BACKGROUND

It is a well-known fact that powder metal technique gives distinct advantages in producing near net shape products, i.e. products which give directly from powder, a finished product with minimum material and energy waste to a final cost lower than conventional production via forged, cast and/or machined parts. In many cases the properties of the powder metal product are superior.

Sintering of steel powder to full density is receiving an increasing interest due to the economics and energy savings in this process. This process usually requires high sintering temperatures unless the steel powder is mixed with a low melting additive, which acts like a glue for the more high melting powder. Two typical low melting additives are cupper and boron. However as these additions have detrimental effects on some of the properties for a steel product, for example welding or corrosion, these types of additions are prohibitive when fully dense parts from steel powder shall be produced meeting the requirements of wrought steel.

Another way to produce fully dense products via sintering is to use high temperatures in order to increase the sintering speeds and reach full density.

In the patent EP 1 047 518, it is shown that a high speed compaction process (HVC process) together with an agglomerated spherical metal powder offers distinct advantages.

In metal injection molding (MIM) an extremely fine powder, usually around 20 micron, is used giving the possibility to sinter to full density, due to the high surface activity of the fine and pure powders, which are usually gas atomized. These fine powders are very costly to produce and usually difficult or impossible to use for products with larger weight such as over for instance 50-100 grams.

Another way to produce fully dense products from powder with properties equal or better than wrought products is to use hot isostatic pressing (HIP) of a powder mass. The mass of powder must then be encapsulated in a "capsule", i.e. a container which embeds the powder mass against the surrounding pressure medium, normally argon gas. The container normally used is made of a steel sheet. Practically and economically this makes the technique limited to relatively large parts, normally for instance 5 kg or more. There are also limitations regarding more complicated shapes due to the cost of capsule fabrication.

This means that there is an important product area ranging from approximately 50 grams up to about 5 kg which today for economical and practical reasons can't be efficiently targeted using the present state of the art.

One limitation when using compaction of metal powder, is that even if it is possible to get very high green densities, which is favorable in order to reach full density, for certain alloys the high temperature sintering can give problems due to formation of different phases or precipitations, which cannot be eliminated in later processes such as hardening, tempering or soft annealing, as there are no further breaking of such structures due to the near net shape product.

One area where there is room for improvement is that at high temperatures, especially when different structural phases occur critical grain growth can occur, i.e. big grains are formed which further impair the mechanical properties, especially impact properties and elongation. This is especially true when the material before sintering has been subjected to a small cold deformation. In such a case critical grain growth occurs easier.

Powder products, which have not reached full density cannot be hot isostatic pressed (hipped) without an enclosing container, because interconnecting porosity in the powder product makes the HIP operation useless. However, if the density of the pressed product is high enough approaching the full theoretical density, the pressed product can be hipped without a capsule and thereby reaching full density if the right parameters are used. This is usually done at a lower temperature than by high temperature sintering, thereby avoiding the above mentioned problems with precipitations and grain growth. As a rule of thumb green density over 95% TD gives a closed porosity and these products can therefore be hot isostatic pressed to full density without encapsulation.

Another room for improvement concerns the upper limit of densification. Due to the adiabatic effect, described in the patent EP 1 047 518, it is possible to reach very high densities, way over the conventional pressing technique. However, due to the need for debinding the binder such as a hydrocolloid it is necessary to stop the densification at a certain upper limit to allow the binder to evaporate during this step.

Other phenomena can also occur at extremely high densities with the binder incorporated, such as for instance blisters in the surface.

In the state of the art carbides accumulate and are preserved when the sintered body cools down after sintering at high temperature. These types of structures are impossible or very difficult to remove by subsequent heat treatment at lower temperatures, due to high content of carbide forming agents such as vanadium, tungsten, and chromium. In conventional production these types of structures are broken down in subsequent rolling, forging etc, when the cast structure is further processed to the final product of bars, sheet etc. Impact values are normally ranging between 50 to 150 joule, depending of hardness after hardening/tempering. However when the intention is to produce a net shape or near net shape without any or with only minor subsequent deformation process, this possibility to break down the defect structure does not exist.

SUMMARY

It is an object of the present invention to obviate at least some of the disadvantages in the prior art and provide an improved method.

In a first aspect there is provided a method for the manufacture of a metal part, the method comprising the steps: a) compacting agglomerated spherical metal powder to a preform, b) debinding and sintering the preform to a part at a temperature not exceeding 1275° C., c) performing one of the following steps i) compacting the part to a density of more than 95% TD, or ii) compacting the part to a density of less than 95% TD and sintering the part at a temperature not exceeding 1275° C. to a density of more than 95% TD, and d) subjecting the part to hot isostatic pressing at a temperature not exceeding 1200° C.

In a second aspect there is provided a metal part manufactured according to the invention.

One advantage of the invention is that it provides an industrial process to produce fully dense sintered parts from alloys which cannot be produced according to the state of the art and still give good impact properties.

DESCRIPTION OF THE DRAWINGS

The invention is further described with the aid of the following drawings in which.

Figure 1:
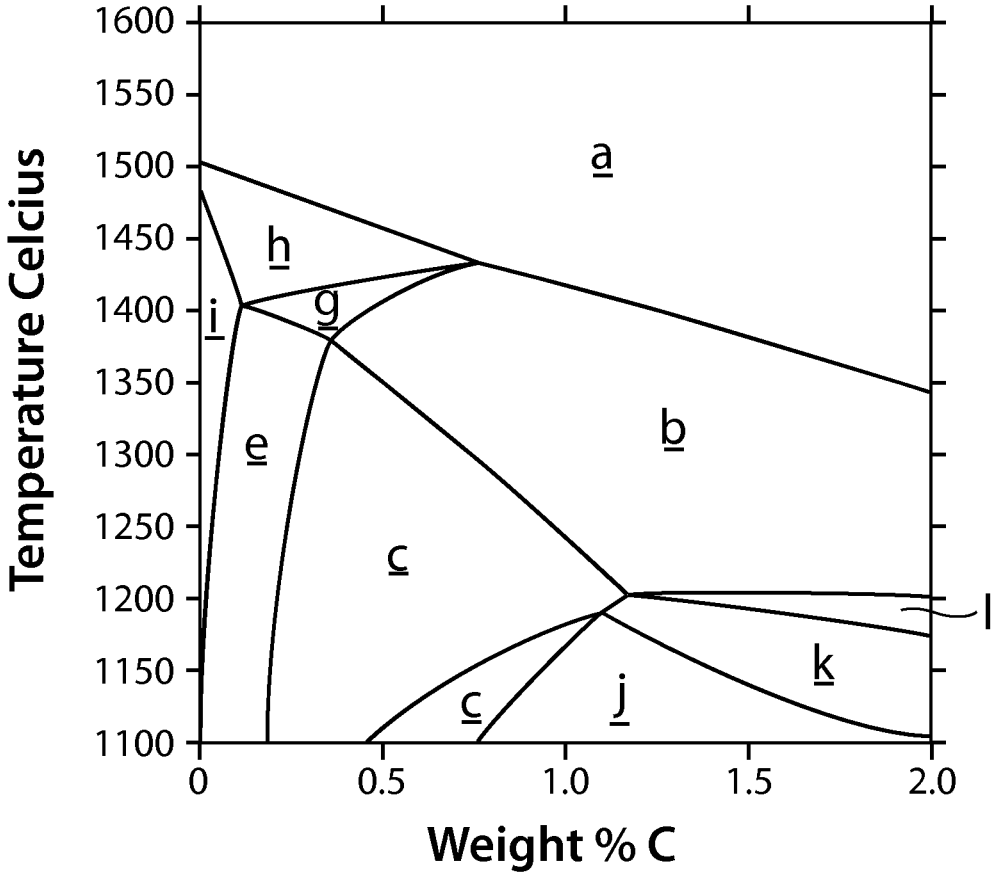
FIG. 1 shows a phase diagram calculated by Thermo Calc for steel 357.
Figure 2:
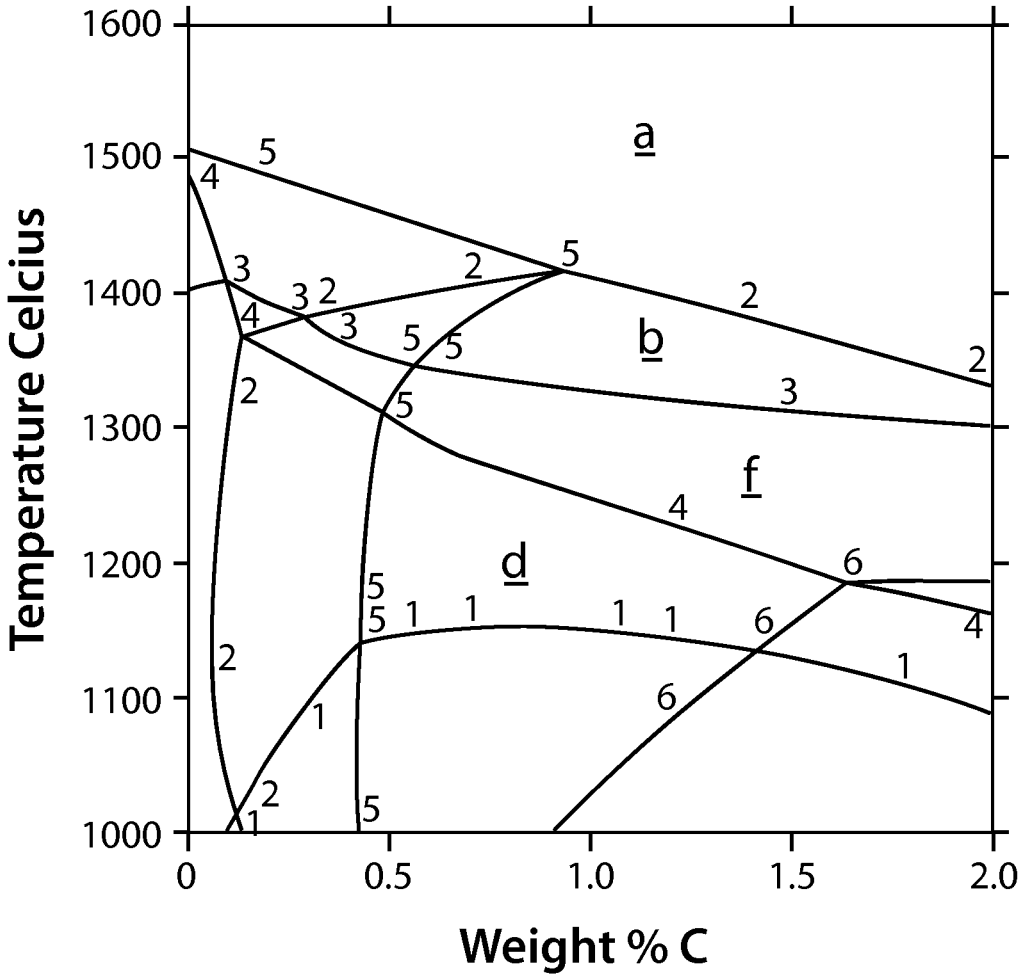
FIG. 2 shows a phase diagram calculated by Thermo Calc for a high speed steel.
Figure 3A:
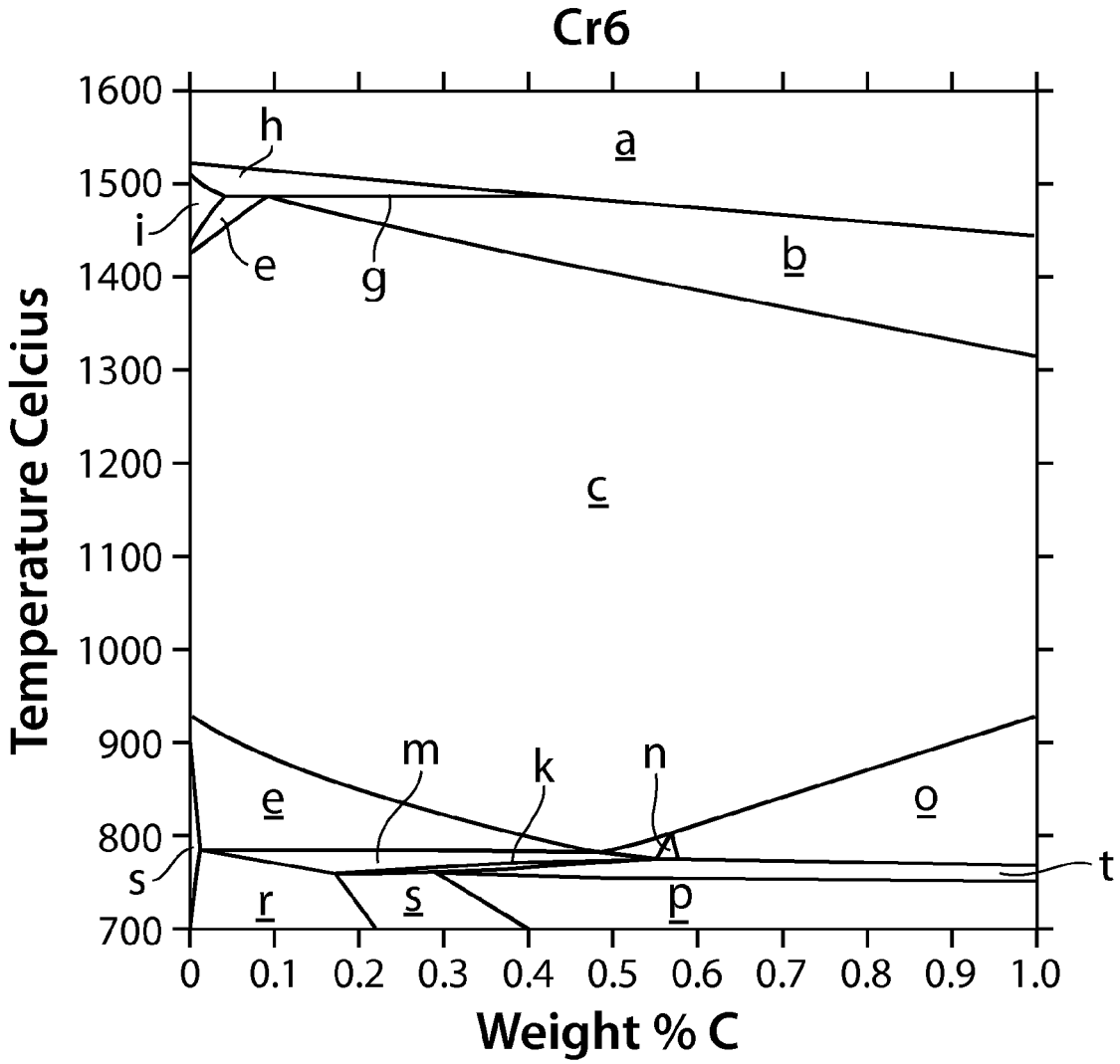
FIG. 3*a* shows a phase diagram calculated by Thermo Calc for a steel used in examples 10-12.
Figure 3B:
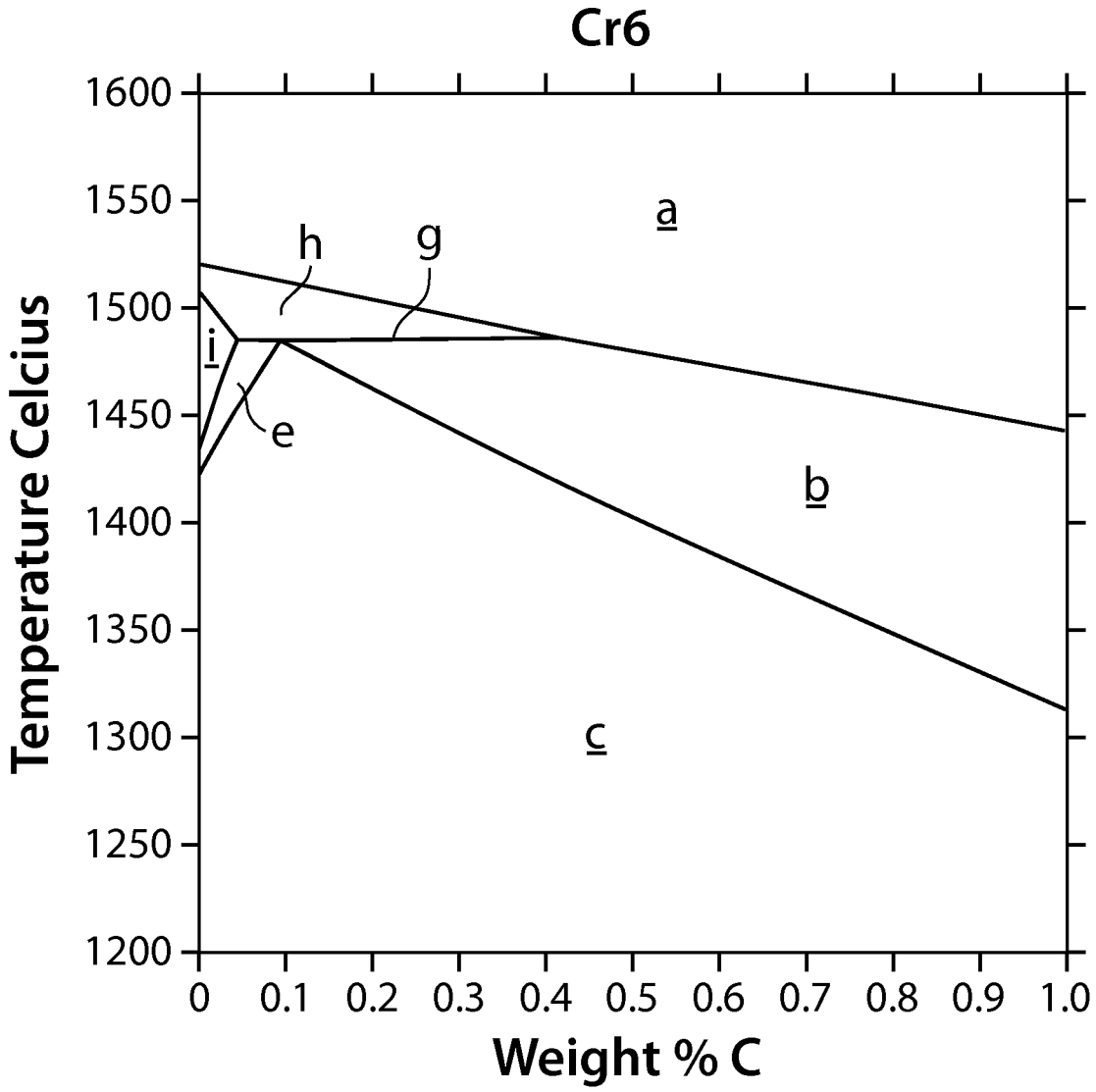
FIG. 3*b* shows a partial enlargement of the phase diagram of FIG. 3*a*.

In the FIGS. 1-3 the letters have the following meaning:

a) Liquid
b) FCC+liquid
c) FCC
d) FCC+MC
e) BCC+FCC
f) Liquid+FCC+MC
g) Liquid+FCC+BCC
h) Liquid+BCC
i) BCC
j) FCC+MC+M7C3
k) FCC+M7C3
l) Liquid+FCC+M7C3
m) BCC+FCC+cementit+M7C3
n) FCC+cementit+M7C3
o) FCC+cementit
p) BCC+cementit
q) FCC+BCC+M7C3
r) BCC+M7C3
s) BCC+FCC+M7C3
t) BCC+FCC+cementit In the figures, the carbon content is given on the x-axis. Normal values for carbon content is approx. 0.5-1.0 wt % but can sometimes for high speed steels with very high resistance to wear be higher. A typical feature for all these types of alloys is that the melting temperature decreases with increasing temperature but also that the areas of mixed phases with liquid phase increase with the carbon content. This means that the upper limitation for avoiding melt phase decreases with increasing carbon content. While it for low carbon high speed steel can go up to close to 1300° C. the upper limit at higher carbon content is approximately 1250° C.

DEFINITIONS

Before the invention is disclosed and described in detail, it is to be understood that this invention is not limited to particular compounds, powders, configurations, method steps, substrates, and materials disclosed herein as such compounds, powders, configurations, method steps, substrates, and materials may vary somewhat. It is also to be understood that the terminology employed herein is used for the purpose of describing particular embodiments only and is not intended to be limiting since the scope of the present invention is limited only by the appended claims and equivalents thereof.

It must be noted that, as used in this specification and the appended claims, the singular forms "a", "an" and "the" include plural referents unless the context clearly dictates otherwise.

If nothing else is defined, any terms and scientific terminology used herein are intended to have the meanings commonly understood by those of skill in the art to which this invention pertains.

The term "about" as used in connection with a numerical value throughout the description and the claims denotes an interval of accuracy, familiar and acceptable to a person skilled in the art. Said interval is ±10%.

The term "cold isostatic press" is used throughout the description and the claims to denote a device in which a component normally is subjected to elevated pressure in a fluid. Pressure is applied to the component from all directions.

The term "density" is used throughout the description and the claims to denote the average density of a body. It is understood that some parts of the body can have a higher density that the average and that some parts of the body can have a lower density.

The term "high speed steel" is used throughout the description and the claims to denote steel intended for use in high speed cutting tool applications. The term "high speed steel" encompasses molybdenum high speed steel and tungsten high speed steel.

The term "hot isostatic press" is used throughout the description and the claims to denote a device in which a component is subjected to both elevated temperature and isostatic gas pressure in a high pressure containment vessel. Pressure is applied to the component from all directions.

The term "sintering" is used throughout the description and the claims to denote a method comprising heating of a powder to a temperature below the melting point of the material until the particles adhere to each other.

The term "soft annealing" is used throughout the description and the claims to denote an annealing where the hardness after soft annealing is brought down to a value allowing the material to be further subjected to a cold deformation.

The term "spherical metal powder" is used throughout the description and the claims to denote metal powder consisting of spherical metal particles and/or ellipsoidal metal particles.

The term "% TD" is used throughout the description and the claims to denote percentage of theoretical density.

Theoretical density in this context is the maximum theoretical density for the material which the part is made of.

The term "tool steel" is used throughout the description and the claims to denote any steel used to make tools for cutting, forming or otherwise shaping a material into a part or component.

The term "uniaxial pressing" is used throughout the description and the claims to denote the compaction of powder into a rigid die by applying pressure in a single axial direction through a rigid punch or piston.

DETAILED DESCRIPTION

In a first aspect there provided a method for the manufacture of a metal part, the method comprising the steps:

a) compacting agglomerated spherical metal powder to a preform, b) debinding and sintering the preform to a part at a temperature not exceeding 1275° C., c) performing one of the following steps i. compacting the part to a density of more than 95% TD, or ii. compacting the part to a density of less than 95% TD and sintering the part at a temperature not exceeding 1275° C. to a density of more than 95% TD, and d) subjecting the part to hot isostatic pressing at a temperature not exceeding 1200° C.

It can be noted that the hot isostatic pressing operation in step d) should not exceed a certain temperature depending on the material to avoid grain growth.

The temperature limit of 1275° C. in the steps b) and c) is for carbon contents towards the lower end of the range 0.5-1.0 wt %. For an embodiment with a carbon content in the middle of the range 0.5-1.0 wt % or higher the limits in steps b) and c) are 1250° C.

In the hot isostatic press the part is subjected to a pressure during a certain holding time. An example of holding time includes but is not limited to 1-2 hours. Bigger products are preferably subjected to longer holding times, such as, but not limited to 3 hours. An example of pressure during the hot isostatic pressing includes but is not limited to 1500 bars.

In one embodiment the compaction in step c) is performed with high velocity compaction. In one embodiment the compaction in step c) i) is performed with high velocity compaction. In one embodiment the compaction in step c) ii) is performed with high velocity compaction. In one embodiment the high velocity compaction is performed with a ram speed exceeding 2 m/s. In another embodiment the high velocity compaction is performed with a ram speed exceeding 5 m/s. In yet another embodiment the high velocity compaction is performed with a ram speed exceeding 7 m/s. In a further embodiment the high velocity compaction is performed with a ram speed exceeding 9 m/s. A high ram speed has the advantage of giving the material improved properties. Without wishing to be bound by any particular scientific theories the inventor believes that the metal at the boundaries between the metal particles melts to some extent during the high velocity compaction and that this gives advantageous connections between the metal particles after the high velocity compaction. Thus an embodiment where step c) comprises high speed compaction offers advantages in respect of for instance an improved impact value of the part. This effect requires a high purity gas atomized powder (of spherical shape) as high contents of surface oxides or other impurities which can hinder this behavior does not exist on these types of powder.

During the high speed compaction there is provided energy to the powder through the punch of the die. The obtained compaction depends on factors including but not limited to the impact ram speed, on the amount of powder to be compacted, the weight of the impact body, the number of impacts, the impact length, and the final geometry of the component. Large amounts of powder usually require more impact than small amounts of powder, also depending on the mechanical properties of said atomized metal.

In one embodiment the compaction in step a) is performed using a method selected from the group consisting of uniaxial pressing, high velocity pressing and cold isostatic pressing.

In one embodiment the compaction in step a) is performed with a pressure not exceeding 1000 N/mm$^2$. In an alternative embodiment the compaction in step a) is performed with a pressure not exceeding 600 N/mm$^2$. In a further embodiment the compaction in step a) is performed with a pressure not exceeding 500 N/mm$^2$. In yet another embodiment the compaction in step a) is performed with a pressure not exceeding 400 N/mm$^2$. In still a further embodiment the compaction in step a) is performed with a pressure not exceeding 300 N/mm$^2$. The pressure of the compaction in step a) must be adapted so that an open porosity exists after the compaction in step a). Normal pressures are between 400 and 1000 N/mm$^2$ due to the life length of the tool.

The density after step a) should not be too high because during the debinding substances should be allowed to evaporate. Thus there shall be an open structure in the compacted metal powder after step a) allowing the binder to evaporate during debinding. If the density becomes too high there is no longer an open porosity and the binder is unable evaporate which may lead to undesired effects. In one embodiment the density after step a) is not higher than 80% TD. In another embodiment the density after step a) is not higher than 85% TD. In yet another embodiment the density after step a) is not higher than 90% TD.

During the debinding in step b) the binder is evaporated. After the debinding, the green preform is sintered. The debinding and sintering is performed by heating the part. In one embodiment the debinding with subsequent sintering is performed in one step.

The types of steel that are most suited for the present method are steels with complicated phase behaviour. In one embodiment the metal powder comprises at least one steel selected from the group consisting of tool steel and high speed steel. In one embodiment the metal powder consists of tool steel. In one embodiment the metal powder consists of high speed steel. In an alternative embodiment another steel type is used. Advantages in connection with steels such as tool steel and high speed steel include that problems associated with their phase behaviour are solved.

In one embodiment a soft annealing is performed after step b). Advantages of the soft annealing includes that the compaction in the subsequent step can be performed easier. In an alternative embodiment soft annealing is achieved during cooling of the steel after the first sintering.

In a second aspect there is provided a metal part manufactured according to the method described above.

In one embodiment the metal part comprises at least one steel selected from the group consisting of tool steel and high speed steel.

In one embodiment the metal part has a ductility measured as impact value on a 10×10 mm unnotched specimen at room temperature of minimum 25 Joule, measured according to the standard SS-EN 10045-1 Charpy V, U notched. In an alternative embodiment the metal part has a ductility of minimum 75 Joule. In another embodiment the metal part has a ductility of minimum 100 Joule. In yet another embodiment the metal part has a ductility of minimum 130 Joule. In yet another embodiment the metal part has a ductility of minimum 130 Joule. In still another embodiment the metal part has a ductility of minimum 200 Joule.

In one embodiment the metal part has a minimum carbon content of 0.5 wt %. In an alternative embodiment the metal part has a maximum carbon content of 0.6 wt %. In yet another embodiment the metal part has a maximum carbon content of 0.65 wt %. In one embodiment the metal part has a maximum carbon content of 1.5 wt %. In another embodiment the metal part has a maximum carbon content of 1.5 wt %. In a preferred embodiment the carbon content is in the range 0.5-1.0 wt %.

It is to be understood that this invention is not limited to the particular embodiments shown here. The following examples are provided for illustrative purposes and are not intended to limit the scope of the invention since the scope of the present invention is limited only by the appended claims and equivalents thereof.

EXAMPLES

Manufacturing of Agglomerated Particles

Spherical particles were obtained by pulverisation with a neutral gas of a tool steel bath with the composition C 0.49 wt %; Si 1.2 wt %; Mn 0.34 wt %; Cr 7.3 wt %; Mo 1.4 wt %; V 0.57%. A batch of these particles was prepared using a sieve, with a particle diameter not greater than 150 microns. An aqueous solution with a base of deionised water was prepared, which contained about 30% by weight of gelatine whose gelling strength is 50 blooms. The solution was heated to between 50° C. and 70° C. to completely dissolve the gelatine.

A mixture was made of 95 wt % of the tool steel particles of a diameter not greater than 150 microns and 5 wt % of the aqueous gelatine solution, i.e. 1.5% by weight of gelatine. In order to wet the entire surface of the particles thorough mixing was performed.

As the solution gradually cooled, a gel was formed. Some of the water was allowed to evaporate by the blowing of air, and the mixture of pasty consistency was passed through a sieve with an approximate mesh size of 450 microns. Granules were thus obtained. The granules were dried by air, and then a second sieving stage was carried out in order to separate the granules from each other and in order to calibrate them by size by passing them through a sieve with a mesh size of 400 microns.

The dried granules consisted of agglomerated spherical metallic particles which were firmly bonded together by films of gelatine. A small fraction of granules consisted of isolated spherical metal particles coated with gelatine.

Example 1 (Comparative)

A tool steel with the following analysis is produced into gas atomized powder; C 0.49 wt %; Si 1.2 wt %; Mn 0.34 wt %; Cr 7.3 wt %; Mo 1.4 wt %; V 0.57 wt %.

The powder was manufactured and agglomerated according to the process described above.

Before agglomeration the tool steel powder was soft annealed to give as high density as possible in the green stage after pressing. Typical hardness after soft annealing was max 250 HB.

The powder was pressed to a cylinder of 150 mm diameter and 22 mm height with a pressure of 600 N/mm$^2$. The density was 83.5% TD, measured as weight to dimension. The pressed specimen was sintered at 1300° C. in hydrogen.

After the sintering process the density had increased to 87.7% TD. This density is insufficient to give the desired mechanical properties. Especially the impact properties are impaired due to low density caused by porosity.

In steps with 20° C., the sintering temperature was increased up to 1420° C. At 1380° C. and above the density was 100% TD after sintering.

The specimen was hardened to 56 HRC which is a normal value when used in applications of combined wear and impact forces. The impact properties were in all cases very low, between 3-12 joule on a standard 10×10 mm unnotched specimen measured at room temperature. These values are too low for many industrial applications.

A metallographic investigation showed that while porosity was the cause for low impact properties at the lower temperatures, grain boundary precipitations were the cause for low impact values at the higher temperatures, even when the density was 100% of TD.

Investigations with SEM (scanning electron microscope) showed that the precipitations consisted of carbides, mainly M23C6 and MC types (M=metal and C=carbon). These precipitations initiate cracks and explain the low ductility values. This structure is explained by a phase diagram (for example the one calculated by Thermo Calc, see FIG. 1), where melting phases increasingly exist at higher temperature. Within these regions carbides accumulates and are preserved when the sintered body cools down after sintering. These types of structures are impossible or very difficult to remove by subsequent heat treatment at lower temperatures, since the intention with the present process is to produce a net shape or near net shape without any or with only minor subsequent deformation process.

Example 2

Another test was performed with the same material as in example 1. After the same pressing operation and sintering at 1250° C., the density was 85% TD. The material was soft annealed and thereafter uniaxially pressed once more, now to a final green density of 92.3% TD. After this operation, the pressed product was once more sintered at 1250° C. to a density of 95.2% TD. The sintered product was then inserted in a hot isostatic press and pressed without encapsulation to full density at a temperature of 1150° C. and a pressure of 1500 bar.

The micro structure of the product showed a uniform structure with evenly dispersed carbides. After normal hardening and tempering to a hardness of 56 HRC, the impact values were measured to 120-132 joule i.e. a satisfactory value for many industrial applications.

Example 3

The same green product as in example 2 with 92.3% of T.D. was directly subjected to hot isostatic pressing at 1150° C. Density of the product was 99.2% TD. Microstructure revealed areas with high porosity, while other areas were fully dense. The impact values after the same hardening and tempering gave values between 15 and 85 joule depending on the scattered porosity of the product.

Example 4

Another test was performed with the same material as in example 1. After the same pressing and sintering as in example 2 to a green density of 85% TD., the product was restriked with high velocity compaction (HVC) to a green density of 95.8% TD, higher than before due to the effect of the adiabatic HVC compaction. The ram speed was 7.5 m/s. The product was then hot isostatic pressed as above at 1150° C., without any final sintering, to full density. The impact values were measured to 140-175 joule, i.e. even better values than above.

Example 5 (Comparative)

Experiment with a steel with the composition C 0.65 wt %; Cr 4.0 wt %; Mo 2.0 wt %; W 2.1 wt %; V 1.5 wt %; Si 1.0 wt %; Mn 0.3 wt %. As before in example 1 the experiment started with a sintering temperature of 1300° C.

and with 20° C. increase in sintering temperature for each step. The sintering operations were stopped at 1380° C. due to heavy melting of the pieces, thereby causing heavy distortion of the product. The result of these tests was the same as the above tests. The green density after pressing was 82% TD. Low densities at the lower sintering temperatures and heavy precipitations at full density at the higher sintering temperatures with very low impact values, between 3-6 joule. A phase diagram calculated for this steel with thermo calc is shown in FIG. 2.

Example 6 and 7

A test was performed with a high speed steel with composition C 0.65 wt %; Cr 4.0%; Mo 2.0%; W 2.1%; V 1.5%; Si 1.0%; Mn 0.3%. The pressed specimens were sintered at 1200 and 1250° C. respectively, which gave a density of 84.5 and 86% TD respectively. The two types of samples were then soft annealed at 950° C. as specified for these types of steels and then pressed uniaxially with a pressure of 600 N/mm$^2$ to a density of 90.7 and 92.1% TD. respectively. The samples were then sintered again at 1200° C. and 1250° C. respectively in the following scheme.

| Presintering at 1200° C. | | Presintering at 1250° C. | |
|---|---|---|---|
| Sinter at: 1200° C./A1 | Sinter at: 1250° C./A2 | Sinter at: 1200° C./B1 | Sinter at: 1250° C./B2 |
| The following densities were measured on the respective specimen. | | | |
| A1: 93.2% TD. | A2: 95.7% TD. | B1: 95.1% TD. | B2: 97.1% TD. |

All specimens were hot isostatic pressed at 1150° C. giving full density for A2, B1 and B2, while A1 gave some scattered porosity. In all cases the impact values were better than for the one high temperature sintering as above with values ranging from 25 joule for A1 to 235 joule for B1. A1 displayed a low value due to local porosity.

Example 8

Another test was performed with the high speed steel of example 6 and 7. The specimens were pressed and sintered to a density of 84% TD. and soft annealed and subsequently HVC restriked with a ram speed of 9.7 m/s to a green density of 95.6% TD and then directly hot isostatic pressed as above to full density. The impact value after hardening and tempering to 56 HRC was 225 joule. The microstructure revealed a fully dense structure with fine grains (ASTM 7-8). No grain boundary precipitations were detected.

Example 9

Example 2 was repeated but with a sintering temperature of 1275° C. in both cases. After the first sintering the density was 86.2% TD and after the second sintering the density was 96.3% TD. The structure was satisfactory with ductility in the range 90-102 joule.

Example 10, 11 and 12

A carbon steel (100 Cr6) with a composition of Fe=bal, C=0.93, Si=0.28, Mn=0.41, P=0.007, S=0.006, Cr=1.52, Ni=0.15, Cu=0.07, was agglomerated as in example 1. The proportions are calculated by weight. (Fe=bal means that Fe is added up to 100 wt %) The phase diagram for this alloy, is shown in FIG. 3. The powder was soft annealed before agglomeration. The agglomerated powder was cold isostatic pressed at 5500 bar to a density of 85.2% T.D in cylinders with dimensions diameter 75 mm×height 30 mm.

The product was then debinded and sintered at 1200° C. with a holding time of 1.5 hr to a density of 87.3% TD. The material was then soft annealed.

In example 10 the product was uniaxially pressed to 90.8% TD at 850 N/mm$^2$. The product was then sintered at 1325° C. with a holding time of 1.5 hr to full density. The impact values (10×10 mm, unnotched) after hardening and tempering to 55 HRC were very low, between 4-7 joule.

In example 11, the product was HVC pressed to a density of 96.8% T.D. and then hot isostatically pressed, HIP at 1150° C. and 1400 bar for 2 hr holding time. The impact values measured as before were 142-156 joule.

In example 12, the product was pressed at HVC to a density of 93.2% TD and then sintered at 1275° C. to a density of 96.5% TD. The product was then hot isostatic pressed as in example 11 to full density. The impact values were 127-135 joule.

The invention claimed is:

1. A method for the manufacture of a metal part, the method comprising the sequential steps:

a. compacting agglomerated spherical metal powder to a preform, b. debinding and sintering the preform to a part at a temperature not exceeding 1275° C., c. compacting the part to a density of more than 95% of the theoretical density, and d. next without a second sintering step, subjecting the part to hot isostatic pressing at a temperature not exceeding 1200° C., wherein the compacting in step c is performed with high velocity compaction.

2. The method according to claim 1, wherein the high velocity compaction is performed with a ram speed exceeding 2 m/s.

3. The method according to claim 1, wherein the compaction in step a) is performed using a method selected from the group consisting of uniaxial pressing, high velocity pressing and cold isostatic pressing.

4. The method according to claim 1, wherein the compaction in step a) is performed with a pressure not exceeding 1000 N/mm$^2$.

5. The method according to claim 1, wherein the metal powder comprises at least one steel selected from the group consisting of tool steel and high speed steel.

6. The method according to claim 1, wherein a soft annealing is performed after step b) in claim 1.

* * * * *